US008482502B2

(12) United States Patent
Kim et al.

(10) Patent No.: US 8,482,502 B2
(45) Date of Patent: Jul. 9, 2013

(54) COMMON VOLTAGE GENERATOR, DISPLAY DEVICE INCLUDING THE SAME, AND METHOD THEREOF

(75) Inventors: Si Woo Kim, Hwaseong-si (KR); Jae Sung Kang, Suwon-si (KR); Hyo Jin Kim, Suwon-si (KR); Jong-Hyun Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1026 days.

(21) Appl. No.: 12/385,706

(22) Filed: Apr. 16, 2009

(65) Prior Publication Data

US 2009/0267882 A1 Oct. 29, 2009

(30) Foreign Application Priority Data

Apr. 29, 2008 (KR) ..... 10-2008-0039822

(51) Int. Cl.
*G09G 3/36* (2006.01)

(52) U.S. Cl.
USPC ..... 345/92; 345/98

(58) Field of Classification Search
USPC .. 345/92, 98, 204, 208, 90; 330/252; 315/307
See application file for complete search history.

(56) References Cited

U.S. PATENT DOCUMENTS

| | | | | |
|---|---|---|---|---|
| 6,492,781 | B2 * | 12/2002 | Palmer et al. | 315/307 |
| 7,119,802 | B2 | 10/2006 | Suyama et al. | |
| 2002/0018059 | A1 * | 2/2002 | Yanagi et al. | 345/204 |
| 2003/0151581 | A1 * | 8/2003 | Suyama et al. | 345/98 |
| 2004/0056832 | A1 * | 3/2004 | Abe | 345/90 |
| 2005/0206602 | A1 | 9/2005 | Kojima et al. | |
| 2005/0206642 | A1 | 9/2005 | Kushima et al. | |

FOREIGN PATENT DOCUMENTS

| | | |
|---|---|---|
| CN | 1637792 | 7/2005 |
| CN | 1670576 | 9/2005 |
| CN | 1790472 | 6/2006 |
| JP | 08-078962 | 3/1996 |
| JP | 2005-024583 | 1/2005 |

OTHER PUBLICATIONS

Office Action for corresponding Chinese Application No. 200910137713.1 dated Apr. 25, 2012.

Office Action for corresponding Japanese Application No. 2009-111302 dated Mar. 12, 2013.

* cited by examiner

*Primary Examiner* — Quan-Zhen Wang
*Assistant Examiner* — Yuk Chow
(74) *Attorney, Agent, or Firm* — Harness, Dickey & Pierce

(57) ABSTRACT

The common voltage generator includes an operational amplifier and a plurality of switches. The operational amplifier is configured to amplify a difference between a first voltage and a second voltage and to output the amplified voltage as a common voltage. The plurality of switches are configured to transmit a third voltage and a fourth voltage as a power supply to the operational amplifier in a first voltage output mode and to transmit a fifth voltage and a sixth voltage as a power supply to the operational amplifier in a second voltage output mode.

23 Claims, 10 Drawing Sheets

FIG. 5

| MODE | FIRST VOLTAGE OUTPUT MODE | FIRST COMMON VOLTAGE OUTPUT MODE | SECOND VOLTAGE OUTPUT MODE | SECOND COMMON VOLTAGE OUTPUT MODE |
|---|---|---|---|---|
| VCOM OUTPUT | V3 | VCOMH | VSS | VCOML |
| VCOM_CLK1 | 1 | 1 | 0 | 0 |
| VCOM_CLK2 | 0 | 1 | 1 | 0 |
| SWITCH CONNECTION | S2,S4,S5,S8 | S1,S3,S5,S8 | S1,S3,S6,S7 | S2,S4,S6,S7 |

COMMON VOLTAGE GENERATOR, DISPLAY DEVICE INCLUDING THE SAME, AND METHOD THEREOF

PRIORITY STATEMENT

This application claims priority under 35 U.S.C. §119 to Korean Patent Application No. 10-2008-0039822, filed on Apr. 29, 2008, in the Korean Intellectual Property Office (KIPO), the entire contents of which are incorporated herein by reference.

BACKGROUND

1. Field

Example embodiments of the present invention relate to common voltage generation technology. For example, example embodiments relate to a common voltage generator having a relatively small area and high efficiency, a display device including the same, and a method of generating a common voltage.

2. Description of the Related Art

A thin film transistor liquid crystal display (TFT-LCD) is an example of a flat panel display device and is widely used in televisions, monitors, mobile phones, etc. The TFT-LCD generally includes a source driver, a common voltage generator, and a display panel including a plurality of source lines and a common voltage line.

The source driver outputs an analog voltage corresponding to a digital video signal to one of the plurality of source lines. The common voltage generator outputs to the one of the plurality of source lines a common voltage (e.g., a first common voltage or a second common voltage having a lower voltage level than the first common voltage) that has an opposite polarity to the analog voltage in order to prevent degradation of a liquid crystal.

The common voltage generator varies the first common voltage or the second common voltage to improve the picture quality of a liquid crystal. However, a conventional common voltage generator includes a plurality of amplifiers, a plurality of external capacitors, a plurality of multiplexers, and an external pad for the connection of the external capacitors, thereby requiring a relatively large power consumption and large chip size as well as increasing the entire cost of a module including the conventional common voltage generator.

SUMMARY

Example embodiments of the present invention provide a common voltage generator having a relatively small area and high efficiency, a display device including the same, and a method thereof.

In one example embodiment, the common voltage generator includes an operational amplifier configured to amplify a difference between a first voltage and a second voltage and to output the amplified voltage as a common voltage, and a plurality of switches configured to transmit a third voltage and a fourth voltage as a power supply to the operational amplifier in a first voltage output mode and to transmit a fifth voltage and a sixth voltage as a power supply to the operational amplifier in a second voltage output mode.

According to an example embodiment, the common voltage generator includes a voltage divider connected between an output terminal and a first node and configured to divide a voltage between the output terminal and the first node and output the divided voltage as the first voltage to a first input terminal, wherein the operational amplifier includes the first input terminal receiving the first voltage and a second input terminal receiving the second voltage, and outputs the common voltage to the output terminal, and wherein the plurality of switches are further configured to transmit the fourth voltage to the first node in the first voltage output mode and transmit a seventh voltage to the first node in the second voltage output mode.

In an example embodiment, the common voltage generator further includes an input voltage generation unit configured to select and transmit one of a plurality of voltage levels determined by dividing the seventh voltage in response to a first output control signal as the second voltage to the second input terminal in the first voltage output mode and configured to select and transmit another of the plurality of voltage levels in response to a second output control signal as the second voltage to the second input terminal in the second voltage output mode.

According to an example embodiment, the input voltage generation unit further includes a resistance divider configured to resistively divide a voltage corresponding to a difference between the fourth voltage and the seventh voltage using at least one resistor and to output the plurality of voltage levels, and a multiplexer configured to select and output one of the plurality of voltages levels output from the resistance divider in response to the first output control signal as the second input voltage and configured to select and output another one of the plurality of voltage levels in response to the second output control signal as the second input voltage.

In an example embodiment, the plurality of switches are further configured to transmit the fifth voltage and the sixth voltage as the power supply to the operational amplifier in a third voltage output mode and to transmit the third voltage and the fourth voltage as the power supply to the operational amplifier in a fourth voltage output mode.

According to an example embodiment, the operational amplifier outputs the common voltage to satisfy a relationship of a magnitude of the common voltage in the first output mode>the magnitude of the common voltage in the third output mode>the magnitude of the common voltage in the fourth output mode>the magnitude of the common voltage in the second output mode.

In an example embodiment, the plurality of switches are configured so that the common voltage changes according to one of a first and second order, where the first order follows a sequence of the second output mode, the third output mode, the first output mode and the fourth output mode, and where the second order follows a sequence of the fourth output mode, the first output mode, the third output mode, and the second output mode.

According to an example embodiment, the plurality of switches are further configured to transmit the fourth voltage to the first node in the third voltage output mode and transmit a seventh voltage to the first node in the fourth voltage output mode.

In an example embodiment, the common voltage generator further includes an input voltage generation unit configured to select and transmit one of a plurality of voltage levels determined by dividing the seventh voltage in response to a first output control signal as the second voltage to the second input terminal in the third voltage output mode and configured to select and transmit another of the plurality of voltage levels in response to a second output control signal as the second voltage to the second input terminal in the fourth voltage output mode.

According to an example embodiment, the plurality of switches includes a first switch pair connected to a first power supply terminal of the operational amplifier and configured to transmit one of the third voltage and the fifth voltage to the first power supply terminal, a second switch pair connected to a second power supply terminal of the operational amplifier and configured to transmit one of the fourth voltage and the sixth voltage to the second power supply terminal, and a third switch pair connected to the first node and configured to transmit one of the fourth voltage and a seventh voltage to the first node.

In an example embodiment, the first switch pair includes a first switch configured to transmit the third voltage to the first power supply terminal in response to a first switch control signal and a second switch configured to transmit the fifth voltage to the first power supply terminal in response to a second switch control signal, the second switch pair includes a third switch configured to transmit the fourth voltage to the second power supply terminal in response to a third switch control signal and a fourth switch configured to transmit the sixth voltage to the second power supply terminal in response to a fourth switch control signal, and the third switch pair includes a fifth switch configured to transmit the seventh voltage to the first node in response to a fifth switch control signal and a sixth switch configured to transmit the fourth voltage to the first node in response to a sixth switch control signal.

According to an example embodiment, the first and third switch control signals have logic levels respectively complementary to logic levels of the second and fourth switch control signals, and the fifth switch control signal and the sixth switch control signal have complementary logic levels.

In an example embodiment, the common voltage generator further includes at least one capacitor connected between the first power supply terminal and the second power supply terminal configured to decrease a switching noise of at least one of the first switch pair and the second switch pair.

According to an example embodiment, an input voltage generation unit is configured to select and transmit one of a plurality of voltage levels in response to a first output control signal as the second voltage in the first voltage output mode and configured to select and transmit another of the plurality of voltage levels in response to a second output control signal as the second input voltage in the second voltage output mode.

In an example embodiment, input voltage generation unit determines the plurality of voltage levels correspond to a difference between a seventh voltage and the fourth voltage using at least one resistor.

In one example embodiment, a display device includes a source driver, a display panel, and the common voltage generator.

In one example embodiment, a method of generating a common voltage includes outputting a first common voltage using a first power voltage and a second power voltage as a power supply for an operational amplifier, and outputting a second common voltage using a third power voltage and a fourth power voltage as the power supply for the operational amplifier.

According to an example embodiment, the method further includes outputting a third common voltage using the third power voltage and the fourth power voltage as the power supply for the operational amplifier before the outputting the first common voltage, and outputting a fourth common voltage using the first voltage and the second voltage as the power supply for the operational amplifier after the outputting the first common voltage.

In an example embodiment, a magnitude of the first, second, third and fourth common voltages satisfy a relationship of the first common voltage>the third common voltage>the fourth common voltage>the second common voltage.

In one example embodiment, a common voltage generator includes an operational amplifier configured to amplify a difference between a first voltage received at a first input terminal and a second voltage received at a second input terminal and to output the amplified voltage as a common voltage to an output terminal, a voltage divider connected between the output terminal and a first node and configured to divide a voltage between the output terminal and the first node and output the divided voltage as the first voltage to the first input terminal, and an input voltage generation unit configured to select and transmit one of a plurality of voltage levels in response to a first output control signal as the second voltage in a first voltage output mode and configured to select and transmit another of the plurality of voltage levels in response to a second output control signal as the second voltage in a second voltage output mode.

BRIEF DESCRIPTION OF THE DRAWINGS

The above and other features and advantages of the present invention will become more apparent by describing in detail example embodiments thereof with reference to the attached drawings in which:

FIG. 5 is a diagram illustrating output voltages of the common voltage generator shown in FIG. 2 according to switching signals;

DETAILED DESCRIPTION OF EXAMPLE EMBODIMENTS

Figure 1:
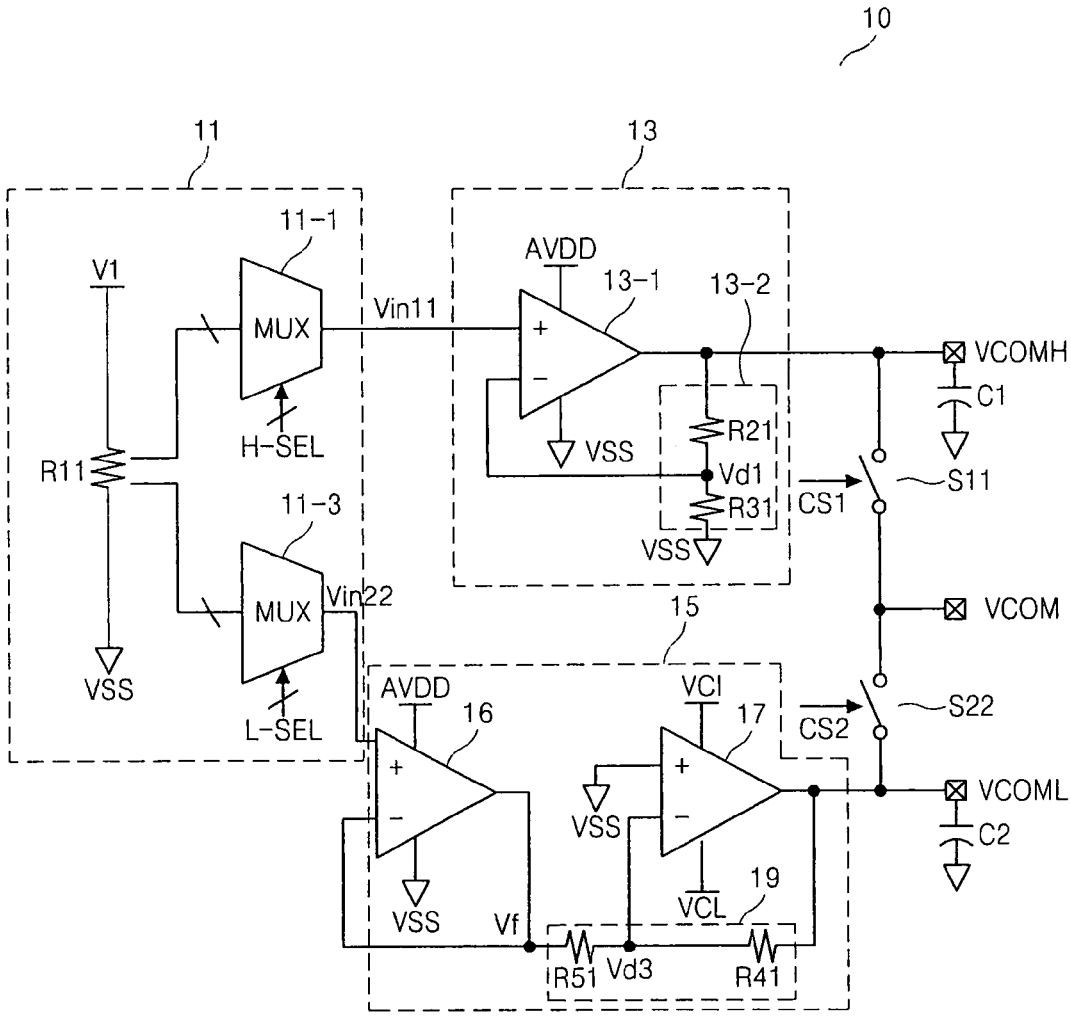
FIG. 1 (CONVENTIONAL ART)
FIG. 1 is a circuit diagram of a conventional common voltage generator.

Example embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

Spatially relative terms, such as "beneath," "below," "lower," "above," "upper," and the like may be used herein for ease of description to describe the relationship of one component and/or feature to another component and/or feature, or other component(s) and/or feature(s), as illustrated in the drawings. It will be understood that the spatially relative terms are intended to encompass different orientations of the device in use or operation in addition to the orientation depicted in the figures. The figures are intended to depict example embodiments and should not be interpreted to limit the intended scope of the claims. The accompanying figures are not to be considered as drawn to scale unless explicitly noted.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 is a circuit diagram of a conventional common voltage generator 10. The common voltage generator 10 includes a common voltage output terminal VCOM, an input voltage generation unit 11, a first common voltage generation unit 13, a first external capacitor C1, a second common voltage generation unit 15, a second external capacitor C2, a first switch S11, and a second switch S22.

The common voltage generator 10 outputs a first common voltage VCOMH and a second common voltage VCOML through the common voltage output terminal VCOM. A display panel (not shown) includes a common voltage line (not shown) connected with the common voltage output terminal VCOM and a plurality of source lines (not shown). The display panel displays a video signal in response to the first and second common voltages VCOMH and VCOML and an analog voltage corresponding to a digital video signal.

The first and second common voltages VCOMH and VCOML have an opposite polarity to a data voltage written to a liquid crystal and are used for phase inversion to prevent degradation of the liquid crystal. The common voltage generator 10 varies the first common voltage VCOMH and the second common voltage VCOML in order to improve the picture quality of the liquid crystal.

The input voltage generation unit 11 may select one of a plurality of voltage levels determined by resistance division of a voltage corresponding to a difference between a first voltage V1 and a second voltage VSS in response to each of a first input voltage output control signal H-SEL and a second input voltage output control signal L-SEL. The input voltage generation unit 11 outputs a voltage corresponding to the respectively selected level for each of the first common voltage generation unit 13 and the second common voltage generation unit 15. The input voltage generation unit 11 includes a first multiplexer 11-1 and a second multiplexer 11-3.

The first multiplexer 11-1 may select one of a plurality of levels obtained by performing resistance division of the voltage corresponding to the difference between the first voltage V1 and the second voltage VSS using a first resistor R11 in response to the first input voltage output control signal H-SEL. The first multiplexer 11-1 outputs a voltage Vin11 corresponding to the selected level to the first common voltage generation unit 13. The second multiplexer 11-3 may select one of the plurality of levels obtained by performing resistance division of the voltage corresponding to the difference between the first voltage V1 and the second voltage VSS using the first resistor R11 in response to the second input voltage output control signal L-SEL. The second multiplexer 11-3 outputs a voltage Vin22 corresponding to the selected level to the second common voltage generation unit 15.

The first common voltage generation unit 13 may amplify a difference between the output voltage Vin11 of the first multiplexer 11-1 and a voltage Vd1 determined by voltage division of the first common voltage VCOMH and output an amplification result as a new first common voltage VCOMH. The first common voltage generation unit 13 includes a first operational amplifier 13-1 and a first voltage divider 13-2.

The first operational amplifier 13-1 amplifies the difference between the output voltage Vin11 of the first multiplexer 11-1 and the output voltage Vd1 of the first voltage divider 13-2 using a third voltage AVDD and the second voltage VSS as power supply. The first operational amplifier 13-1 outputs an amplification result as the first common voltage VCOMH. The first voltage divider 13-2 is connected between an output node of the first common voltage VCOMH and the second voltage VSS. The first voltage divider 13-2 performs voltage division of the first common voltage VCOMH using a second resistor R21 and a third resistor R31 and outputs the voltage Vd1 to the first operational amplifier 13-1. The first external capacitor C1 is connected with an output terminal of the first operational amplifier 13-1 to stabilize the level of the first common voltage VCOMH.

The second common voltage generation unit 15 buffers the output voltage Vin22 of the second multiplexer 11-3, amplifies a difference between the second voltage VSS and a voltage Vd3 determined by resistance division of a voltage corresponding to a difference between a buffered voltage Vf and the second common voltage VCOML, and outputs an amplification result as a new second common voltage VCOML. The second common voltage generation unit 15 includes a buffer 16, a second operational amplifier 17, and a second voltage divider 19.

The buffer 16 buffers the output voltage Vin22 of the second multiplexer 11-3 using the third voltage AVDD and the second voltage VSS as the power supply and outputs the buffered voltage Vf. The second operational amplifier 17 amplifies a difference between the output voltage Vd3 of the second voltage divider 19 and the second voltage VSS using a fourth voltage VCI and a fifth voltage VCL and outputs an amplification result as the second common voltage VCOML. The second voltage divider 19 is connected between an output terminal of the second operational amplifier 17 and an output terminal of the buffer 16. The second voltage divider 19 may perform voltage division of the second common voltage VCOML using a fourth resistor R41 and a fifth resistor R51 and output the divided voltage Vd3 to the second operational amplifier 17.

The second external capacitor C2 is connected with the output terminal of the second operational amplifier 17 to stabilize the level of the second common voltage VCOML. The first switch S11 is connected between the output terminal of the first operational amplifier 13-1 and the common voltage output terminal VCOM, and transmits the first common voltage VCOMH to the common voltage output terminal VCOM in response to a first switch control signal CS1. The second switch S22 is connected between the output terminal of the second operational amplifier 17 and the common voltage output terminal VCOM, and transmits the second common voltage VCOML to the common voltage output terminal VCOM in response to a second switch control signal CS2.

However, the conventional common voltage generator 10 includes a plurality of amplifiers (e.g., the first operational amplifier 13-1, the second operational amplifier 17, and the buffer 16), a plurality of external capacitors (e.g., C1 and C2), a plurality of multiplexers (e.g., 11-1 and 11-3), and an external pad for connection of the external capacitors, thereby occupying a relatively large area. As a result, the area of a liquid crystal display driver IC increases. Moreover, the common voltage generator 10 requires many external parts, thus increasing a cost of production so as not to be competitive in price.

Figure 2:
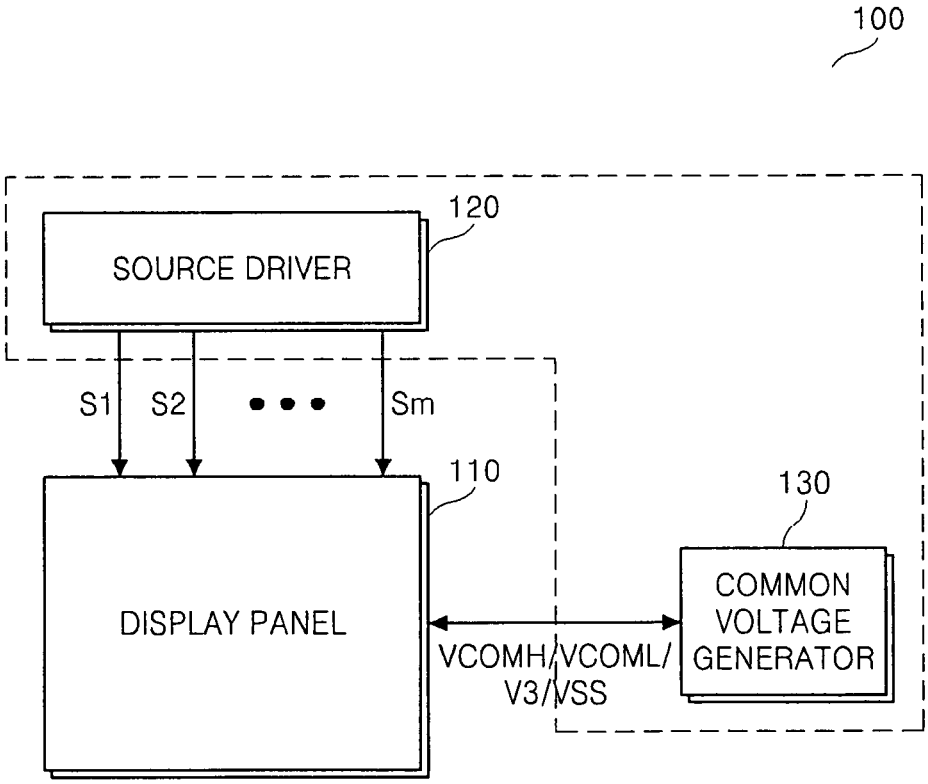
FIG. 2 illustrates a display device including a common voltage generator according to an example embodiment of the present invention.
Figure 3:
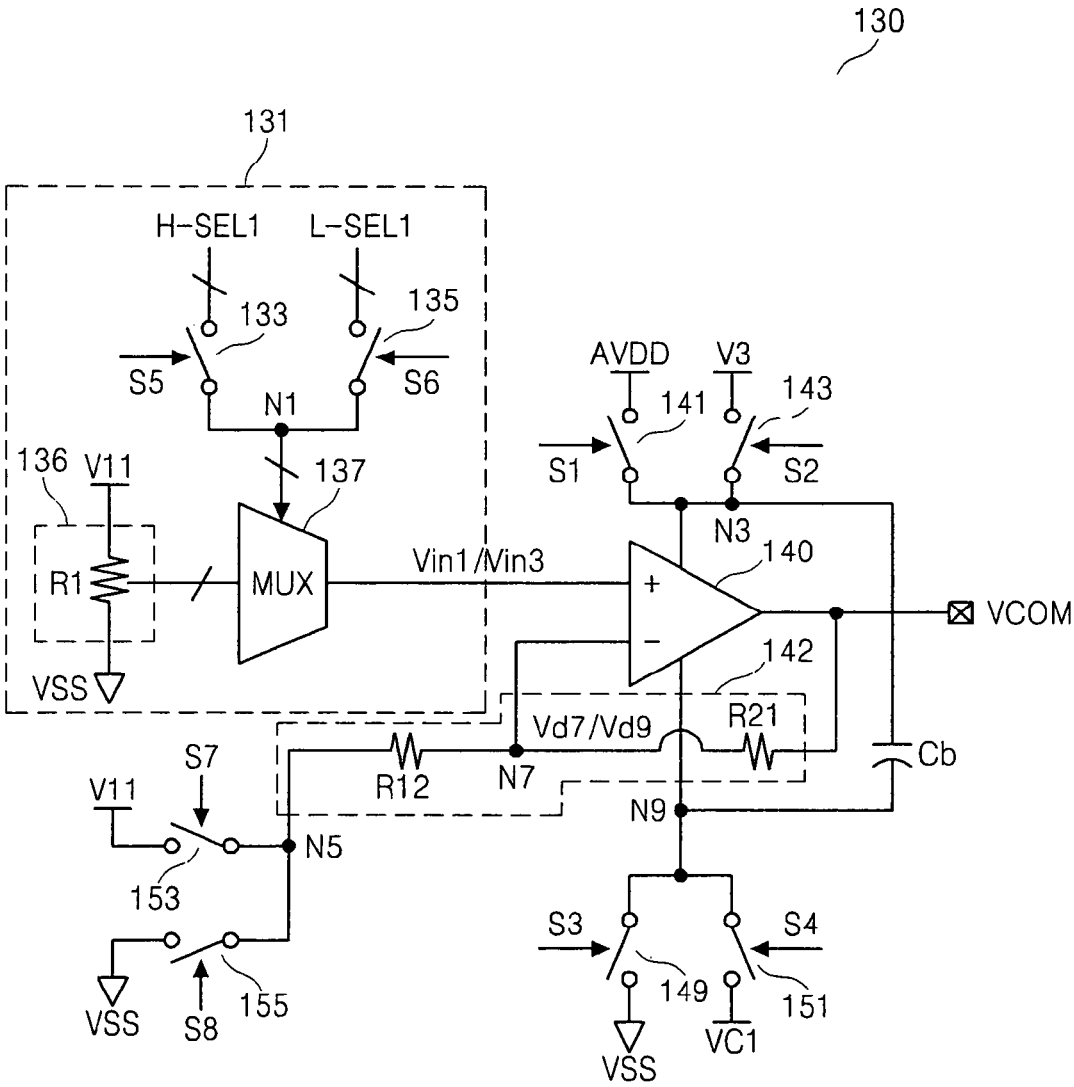
FIG. 3 illustrates the common voltage generator shown in FIG. 2.
Figure 4A:
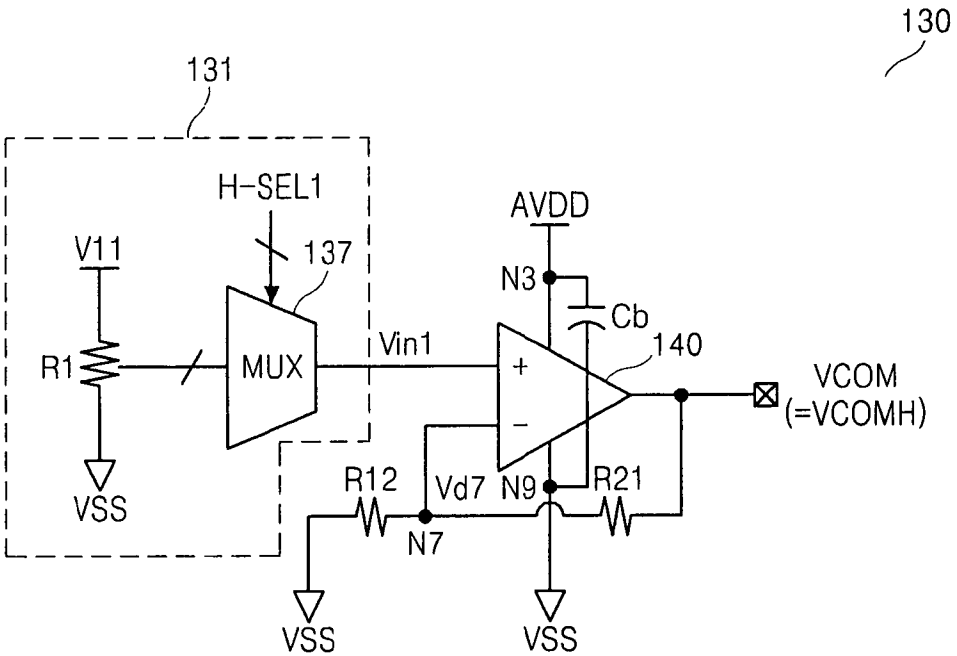
FIGS. 4A through 4D are diagrams illustrating the operations of the common voltage generator shown in FIG. 2.
Figure 4B:
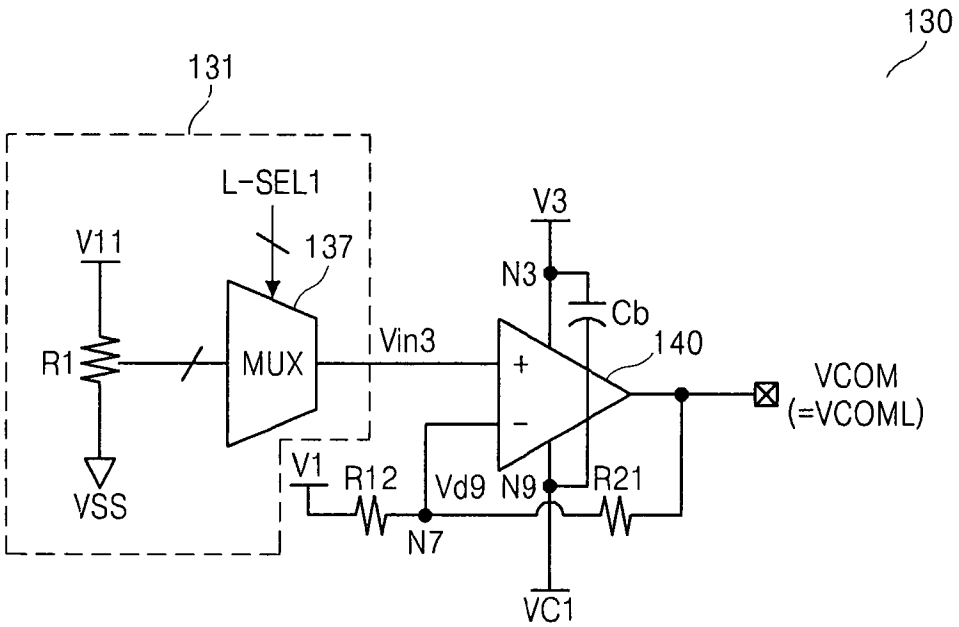
Figure 4C:
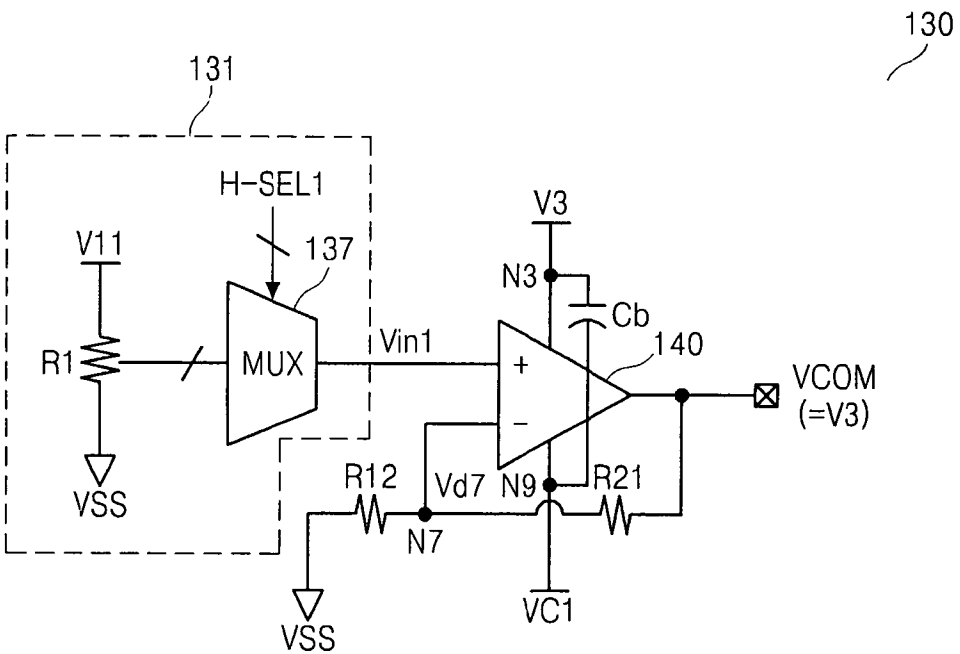
Figure 4D:
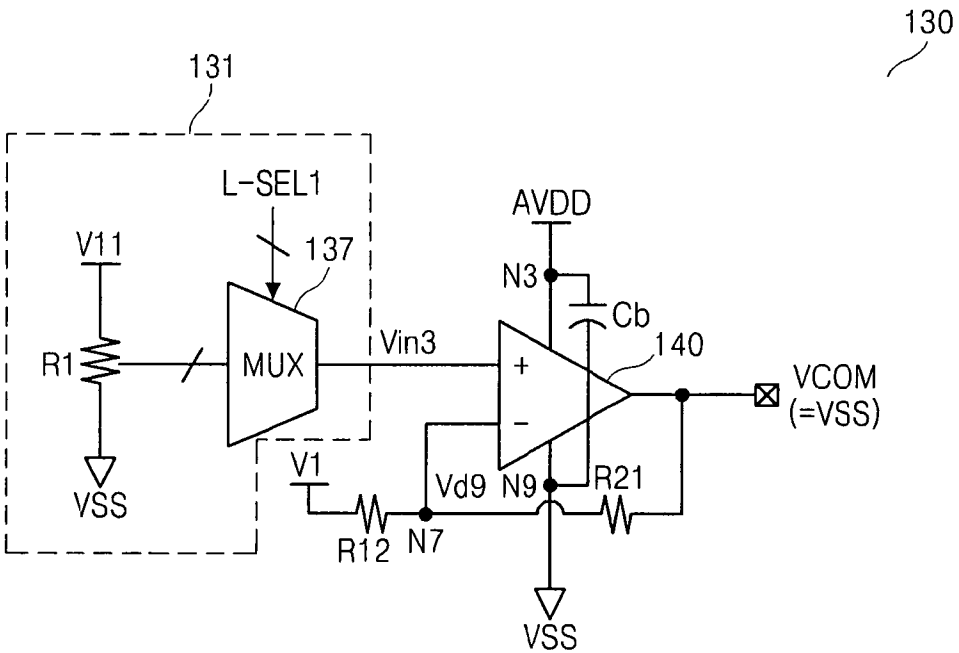
Figure 6:
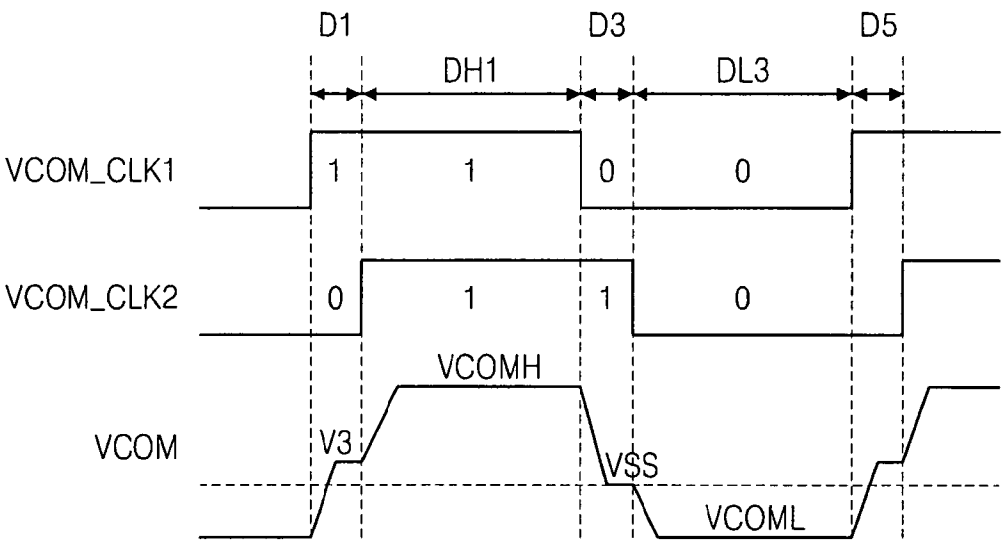
FIG. 6 is a timing chart of the switching signals illustrated in FIG. 2.

FIG. 2 illustrates a display device 100 including a common voltage generator 130 according to an example embodiment of the present invention. FIG. 3 illustrates the common voltage generator 130 shown in FIG. 2. FIGS. 4A through 4D are diagrams illustrating the operations of the common voltage generator 130 shown in FIG. 2. FIG. 5 is a diagram illustrating output voltages of the common voltage generator 130 shown in FIG. 2 according to switching signals. FIG. 6 is a timing chart of the switching signals illustrated in FIG. 2.

Referring to FIGS. 2 through 6, the display device 100 is a flat display device such as a thin film transistor liquid crystal display (TFT-LCD), a plasma display panel (PDP), or an organic light emitting diode (OLED). The display device 100 includes a display panel 110, a source driver 120, and a common voltage generator 130. The source driver 120 and the common voltage generator 130 may be implemented in one chip or in separate chips.

The display panel 110 includes a plurality of source lines S1 through Sm and a common voltage line (not shown) and displays video signals in response to a common voltage (e.g., a first common voltage VCOMH, a second common voltage VCOML, a first voltage V3, or a second voltage VSS) applied to the common voltage line and analog voltages corresponding to digital video signals transmitted to the source lines S1 through Sm.

The source driver 120 generates analog voltages corresponding to input digital video signals and transmits the analog voltages to the source lines S1 through Sm.

The common voltage generator 130 outputs one of a plurality of voltages (e.g., the first common voltage VCOMH, the second common voltage VCOML, the first voltage V3, or the second voltage VSS) through a common voltage output terminal VCOM. The first common voltage VCOMH and the second common voltage VCOML among the voltages (i.e., VCOMH, VCOML, V3, and VSS) output from the common voltage generator 130 have an opposite polarity to a data voltage written to a liquid crystal and are used for phase inversion to prevent degradation of the liquid crystal. The common voltage generator 130 varies the first common voltage VCOMH and the second common voltage VCOML in order to improve the picture quality of the liquid crystal. As shown in FIG. 3, the common voltage generator 130 may include an input voltage generation unit 131, an operational amplifier 140, a plurality of switches 141, 143, 149, 151, 153, and 155, a voltage divider 142, and a capacitor Cb.

The input voltage generation unit 131 may select one of a plurality of levels determined by dividing a third voltage V11 in response to a first input voltage output control signal H-SEL1 and a second input voltage output control signal L-SEL1, and output a voltage Vin1/Vin3 corresponding to the selected level to the operational amplifier 140. The input voltage generation unit 131 includes a resistance divider 136, a multiplexer 137, a first selection switch 133, and a second selection switch 135.

The resistance divider 136 may perform resistance division of a voltage corresponding to a difference between the third voltage V11 and the second voltage VSS using at least one resistor R1 and output divided voltages.

The multiplexer 137 may select one of voltage levels output from the resistance divider 136 in response to the first input voltage output control signal H-SEL1 and output a first input voltage Vin1 corresponding to the selected voltage level to the operational amplifier 140. In addition, the multiplexer 137 may select another one of the voltage levels output from the resistance divider 136 in response to the second input voltage output control signal L-SEL1 and output a second input voltage Vin3 corresponding to the selected voltage level to the operational amplifier 140. The magnitude of the first input voltage Vin1 may be the same as or different from that of the second input voltage Vin3. Preferably, the magnitude of the first input voltage Vin1 may be greater than that of the second input voltage Vin3.

The first selection switch 133 may transmit the first input voltage output control signal H-SEL1 to the multiplexer 137 in response to a first selection signal S5. The second selection switch 135 may transmit the second input voltage output control signal L-SEL1 to the multiplexer 137 in response to a second selection signal S6.

The operational amplifier 140 may amplify a difference between an input voltage (e.g., the first input voltage Vin1 or the second input voltage Vin3) and a divided voltage Vd7 or Vd9 and output an amplified voltage as a common voltage. The operational amplifier 140 may include a first input terminal (e.g., a negative input terminal), a second input terminal (e.g., a positive input terminal), a first power supply terminal N3, a second power supply terminal N9, and an output terminal VCOM.

In a first common voltage output mode (e.g., a mode illustrated in FIG. 4A and "DH1" in FIG. 6), the switches 141, 143, 149, 151, 153, and 155 may operate such that the second voltage VSS and a fourth voltage AVDD are provided as power supply to the operational amplifier 140 and the first divided voltage Vd7 is transmitted to the first input terminal (−) of the operational amplifier 140. For instance, in the first common voltage output mode, the multiplexer 137 may output the first input voltage Vin1 to the operational amplifier 140 in response to the first input voltage output control signal H-SEL1. At this time, the operational amplifier 140 may amplify a difference between the first input voltage Vin1 and the first divided voltage Vd7, and output an amplified first common voltage VCOMH to the common voltage output terminal VCOM. The magnitude of the first common voltage VCOMH may be expressed by Equation (1):

$$\text{First common voltage } VCOMH = Vin1*(R12+R21)/R12. \quad (1)$$

In a second common voltage output mode (e.g., a mode illustrated in FIG. 4B and "DL3" in FIG. 6), the switches 141, 143, 149, 151, 153, and 155 may operate such that the first voltage V3 and a fifth voltage VC1 are provided as the power supply to the operational amplifier 140 and the second divided voltage Vd9 is transmitted to the first input terminal (−) of the operational amplifier 140. For instance, in the second common voltage output mode, the multiplexer 137 may output the second input voltage Vin3 to the operational amplifier 140 in response to the second input voltage output control signal L-SEL1. At this time, the operational amplifier 140 may amplify a difference between the second input voltage Vin3 and the second divided voltage Vd9 and output an amplified second common voltage VCOML to the common voltage output terminal VCOM. The magnitude of the second common voltage VCOML may be expressed by Equation (2):

$$\text{Second common voltage } VCOML = Vin3 - \{(V1 - Vin3) * R21/R12\}. \quad (2)$$

In a first voltage output mode (e.g., a mode illustrated in FIG. 4C and "D1" and "D5" in FIG. 6), the switches 141, 143, 149, 151, 153, and 155 may operate such that the first voltage V3 and the fifth voltage VC1 are provided as the power supply to the operational amplifier 140 and the first divided voltage Vd7 is transmitted to the first input terminal (−) of the operational amplifier 140. For instance, in the first voltage output mode, the multiplexer 137 may output the first input voltage Vin1 to the operational amplifier 140 in response to the first input voltage output control signal H-SEL1. At this time, the operational amplifier 140 may amplify a difference between the first input voltage Vin1 and the first divided voltage Vd7 and output an amplified first voltage V3 to the common voltage output terminal VCOM. At this time, the operational amplifier 140 may operate to output a voltage greater than the first common voltage VCOMH but saturated by the first voltage V3, which is the power supplied to the operational amplifier 140, thereby outputting the first voltage V3.

In a second voltage output mode (e.g., a mode illustrated in FIG. 4D and "D3" in FIG. 6), the switches 141, 143, 149, 151, 153, and 155 may operate such that the second voltage VSS and the fourth voltage AVDD are provided as the power supply to the operational amplifier 140 and the second divided voltage Vd9 is transmitted to the first input terminal (−) of the operational amplifier 140. For instance, in the second voltage output mode, the multiplexer 137 may output the second input voltage Vin3 to the operational amplifier 140 in response to the second input voltage output control signal L-SEL1. At this time, the operational amplifier 140 may amplify a difference between the second input voltage Vin3 and the second divided voltage Vd9 and output an amplified second voltage VSS to the common voltage output terminal VCOM. At this time, the operational amplifier 140 may operate to output a voltage less than the second common voltage VCOML but saturated by the second voltage VSS, which is the power supplied to the operational amplifier 140, thereby outputting the second voltage VSS.

The magnitudes of the first common voltage VCOMH, the second common voltage VCOML, the second voltage VSS and the first voltage V3 may have a relationship of VCOMH>V3>VSS>VCOML, as shown for example in FIG. 6. In addition, the switches 141, 143, 149, 151, 153, and 155 may operate such that the output voltage of the operational amplifier 140, i.e., the common voltage VCOM, changes in the order the second common voltage VCOML, the first voltage V3, the first common voltage VCOMH, and the second voltage VSS. Alternatively, the above order may also be reversed.

Generally, a display panel (not shown) connected with the common voltage output terminal VCOM of the common voltage generator 130 has a relatively large capacitance and thus consumes a relatively large current. According to an example embodiment of the present invention, the common voltage generator 130 outputs the first voltage V3 or the second voltage VSS as between other voltage levels, such as when inverting the common voltage VCOM from the first common voltage VCOMH to the second common voltage VCOML or vice versa, thereby achieving a lower current consumption operation, e.g., a recycling operation.

As shown in FIG. 3, the switches 141, 143, 149, 151, 153, and 155 may include a first switch pair, a second switch pair, and a third switch pair. The first switch pair may be connected with the first power supply terminal N3 to transmit the first voltage V3 or the fourth voltage AVDD to the first power supply terminal N3, and may include the first switch 141 and the second switch 143. The first switch 141 may transmit the fourth voltage AVDD to the first power supply terminal N3 in response to a first switch control signal S1, and the second switch 143 may transmit the first voltage V3 to the first power supply terminal N3 in response to a second switch control signal S2.

The second switch pair may be connected with the second power supply terminal N9 to transmit the second voltage VSS or the fifth voltage VC1 to the second power supply terminal N9, and may include the third switch 149 and the fourth switch 151. The third switch 149 may transmit the second voltage VSS to the second power supply terminal N9 in response to a third switch control signal S3, and the fourth switch 151 may transmit the fifth voltage VC1 to the second power supply terminal N9 in response to a fourth switch control signal S4.

The third switch pair may be connected with the voltage divider 142 to transmit the second voltage VSS or the third voltage V11 to the voltage divider 142, and may include the fifth switch 153 and the sixth switch 155. The fifth switch 153 may transmit the third voltage V11 to the voltage divider 142 in response to a fifth switch control signal S7, and the sixth switch 155 may transmit the second voltage VSS to the voltage divider 142 in response to a sixth switch control signal S8.

The first and third switch control signals S1 and S3 may have logic levels complementary to those of the second and fourth switch control signals S2 and S4, respectively. The fifth switch control signal S7 and the sixth switch control signal S8 may have complementary logic levels, respectively.

FIG. 5 is a table showing the activation or deactivation of the first through sixth switch control signals S1 through S4, S7, and S8 and the first and second selection signals S5 and S6 according to a first clock signal VCOM_CLK1 and a second clock signal VCOM_CLK2, which are generated by a timing controller (not shown) of the display device 100. Referring to FIG. 5, the first and third switch control signals S1 and S3 may have logic levels complementary to those of the second and fourth switch control signals S2 and S4, respectively. The fifth switch control signal S7 and the sixth switch control signal S8 may have complementary logic levels, respectively. The second selection signal S6 and the first selection signal S5 may have complementary logic levels, respectively.

In more detail, the first and third switch control signals S1 and S3 may be activated in response to the second clock signal VCOM_CLK2 at a first logic level (e.g., a high level of "1") while the second and fourth switch control signals S2 and S4 may be activated in response to the second clock signal VCOM_CLK2 at a second logic level (e.g., a low level of "0"). The sixth switch control signal S8 and the first selection signal S5 may be activated in response to the first clock signal VCOM_CLK1 at a first logic level (e.g., a high level of "1") while the fifth switch control signal S7 and the second selection signal S6 may be activated in response to the first clock signal VCOM_CLK1 at a second logic level (e.g., a low level of "0"). Thus, the common voltage generator 130 may output the first common voltage VCOMH, the second common voltage VCOML, the first voltage V3, or the second voltage VSS to the common voltage output terminal VCOM in response to the first through sixth switch control signals S1 through S4, S7, and S8 and the first and second selection signals S5 and S6. FIG. 6 further illustrates the relationship of the logic levels of the first and second clock signals VCOM_CLK1 and VCOM_CLK2 with the respect to the voltage level of the common voltage output terminal VCOM.

Referring back to FIG. 3, the voltage divider 142 is connected between the common voltage output terminal VCOM and one terminal of each of the switches 153 and 155. The voltage divider 142 may divide a voltage between the second voltage VSS or the third voltage V11 and the common voltage output terminal VCOM using a third resistor R12 and a fourth resistor R21 and output a divided voltage (e.g., the first divided voltage Vd7 or the second divided voltage Vd9) to the first input terminal (−) of the operational amplifier 140.

For instance, the voltage divider 142 may divide a voltage between the second voltage VSS and the common voltage output terminal VCOM and output the first divided voltage Vd7 resulting from the division to the first input terminal (−) of the operational amplifier 140 or may divide a voltage between the third voltage V11 and the common voltage output terminal VCOM and output the second divided voltage Vd9 resulting from the division to the first input terminal (−) of the operational amplifier 140.

The capacitor Cb may be connected between the first and second power supply terminals N3 and N9 of the operational amplifier 140 to decrease or remove switching noise that may occur at the first and second switch pairs, i.e., the switches 141, 143, 149, and 151.

As described above, the common voltage generator 130 is implemented using a smaller area and a smaller number of elements, as compared to the conventional common voltage generator 10 illustrated in FIG. 1. Accordingly, the common voltage generator 130 has a higher efficiency, thereby decreasing power consumption, a chip size, and entire module cost.

Figure 7:
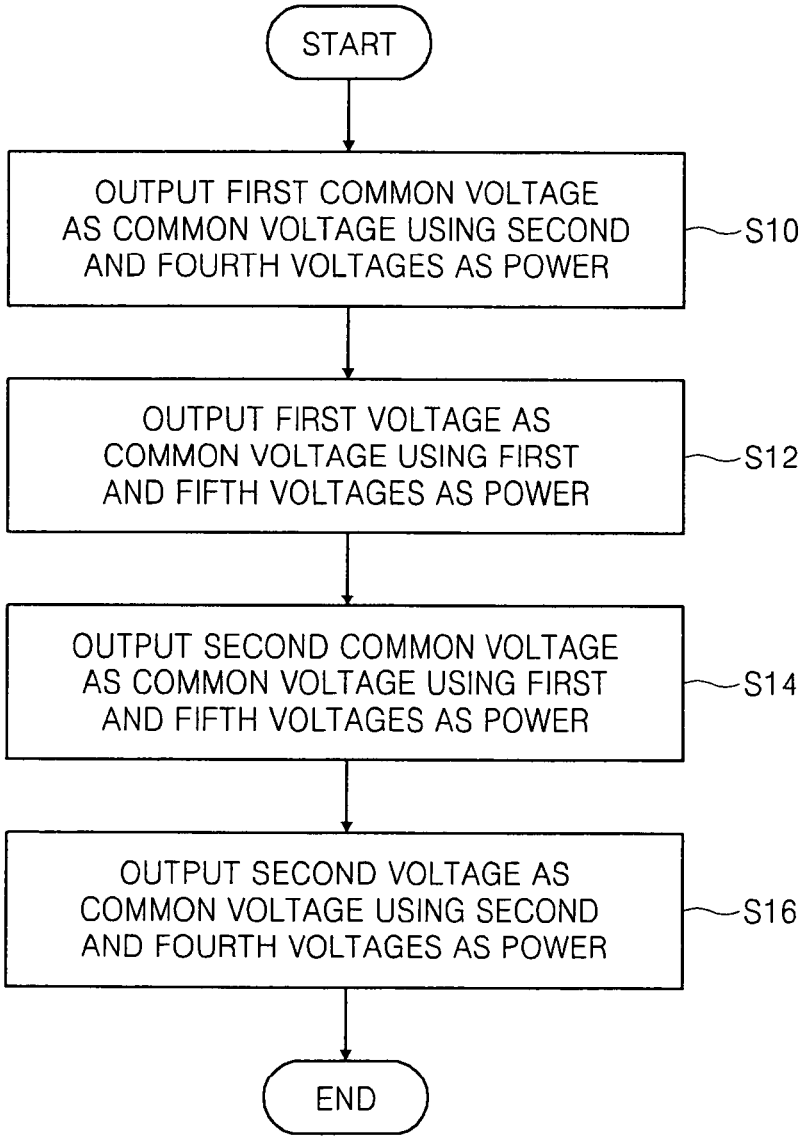
FIG. 7 is a flowchart illustrating a method of generating a common voltage according to an example embodiment of the present invention.

FIG. 7 is a flowchart illustrating a method of generating a common voltage according to an example embodiment of the present invention. Referring to FIGS. 3 and 7, the operational amplifier 140 outputs the first common voltage VCOMH as the common voltage using the second voltage VSS and the fourth voltage AVDD as power supply in operation S10. Then, the operational amplifier 140 outputs the first voltage V3 as the common voltage using the first voltage V3 and the fifth voltage VC1 as the power supply in operation S12. Next, the operational amplifier 140 outputs the second common voltage VCOML as the common voltage using the first voltage V3 and the fifth voltage VC1 as the power supply in operation S14. Lastly, the operational amplifier 140 outputs the second voltage VSS as the common voltage using the second voltage VSS and the fourth voltage AVDD as the power supply in operation S16.

Accordingly, example embodiments of the present invention may require a relatively smaller area and achieve a relatively higher efficiency, so that power consumption, a chip size, and entire module cost may be reduced.

While the present invention has been particularly shown and described with reference to example embodiments thereof, it will be understood by those of ordinary skill in the art that various changes in forms and details may be made therein without departing from the spirit and scope of the present invention as defined by the following claims.

What is claimed is:

1. A common voltage generator comprising:

an operational amplifier having a first input terminal, a second input terminal, a first power supply terminal, a second power supply terminal and an output terminal, the operational amplifier configured to amplify a difference between a first voltage and a second voltage and to output the amplified voltage as a common voltage to the output terminal; and a plurality of switches configured to transmit a third voltage to the first power supply terminal and a fourth voltage to the second power supply terminal as a power supply to the operational amplifier in a first voltage output mode and to transmit a fifth voltage to the first power supply terminal and a sixth voltage to the second power supply terminal as the power supply to the operational amplifier in a second voltage output mode.

2. The common voltage generator of claim 1, further comprising:

a voltage divider connected between the output terminal and a first node and configured to divide a voltage between the output terminal and the first node and output the divided voltage as the first voltage to the first input terminal, wherein the operational amplifier includes the first input terminal receiving the first voltage and the second input terminal receiving the second voltage, and the operational amplifier outputs the common voltage to the output terminal, and wherein the plurality of switches are further configured to transmit the fourth voltage to the first node in the first voltage output mode and transmit a seventh voltage to the first node in the second voltage output mode.

3. The common voltage generator of claim 2, further comprising:

an input voltage generation unit configured to select and transmit one of a plurality of voltage levels determined by dividing the seventh voltage in response to a first output control signal as the second voltage to the second input terminal in the first voltage output mode and configured to select and transmit another of the plurality of voltage levels in response to a second output control signal as the second voltage to the second input terminal in the second voltage output mode.

4. The common voltage generator of claim 3, wherein the input voltage generation unit further comprises:

a resistance divider configured to resistively divide a voltage corresponding to a difference between the fourth voltage and the seventh voltage using at least one resistor and to output the plurality of voltage levels; and a multiplexer configured to select and output one of the plurality of voltage levels output from the resistance divider in response to the first output control signal as the second voltage and configured to select and output another one of the plurality of voltage levels in response to the second output control signal as the second voltage.

5. The common voltage generator of claim 1, wherein the plurality of switches are further configured to transmit the fifth voltage and the sixth voltage as the power supply to the operational amplifier in a third voltage output mode and to transmit the third voltage and the fourth voltage as the power supply to the operational amplifier in a fourth voltage output mode.

6. The common voltage generator of claim 5, wherein the operational amplifier outputs the common voltage to satisfy a relationship of a magnitude of the common voltage in the first output mode>the magnitude of the common voltage in the third output mode>the magnitude of the common voltage in the fourth output mode>the magnitude of the common voltage in the second output mode.

7. The common voltage generator of claim 6, wherein the plurality of switches are configured so that the common voltage changes according to one of a first and second order, where the first order follows a sequence of the second output mode, the third output mode, the first output mode and the fourth output mode, and where the second order follows a sequence of the fourth output mode, the first output mode, the third output mode, and the second output mode.

8. The common voltage generator of claim 5, further comprising:

a voltage divider connected between the output terminal and a first node and configured to divide a voltage between the output terminal and the first node and output the divided voltage as the first voltage to the first input terminal, wherein the operational amplifier includes the first input terminal receiving the first voltage and the second input terminal receiving the second voltage, and the operational amplifier outputs the common voltage to the output terminal, and wherein the plurality of switches are further configured to transmit the fourth voltage to the first node in the third voltage output mode and transmit a seventh voltage to the first node in the fourth voltage output mode.

9. The common voltage generator of claim 8, further comprising:

an input voltage generation unit configured to select and transmit one of a plurality of voltage levels determined by dividing the seventh voltage in response to a first output control signal as the second voltage to the second input terminal in the third voltage output mode and configured to select and transmit another of the plurality of voltage levels in response to a second output control signal as the second voltage to the second input terminal in the fourth voltage output mode.

10. The common voltage generator of claim 9, wherein the input voltage generation unit further comprises:

a resistance divider configured to resistively divide a voltage corresponding to a difference between the fourth voltage and the seventh voltage using at least one resistor and to output the plurality of voltage levels; and a multiplexer configured to select and output one of the plurality of voltages levels output from the resistance divider in response to the first output control signal as the second input voltage and configured to select and output another one of the plurality of voltage levels in response to the second output control signal as the second input voltage.

11. The common voltage generator of claim 1, further comprising:

a voltage divider connected between the output terminal and a first node and configured to divide a voltage between the output terminal and the first node and output the divided voltage as the first voltage to the first input terminal wherein the operational amplifier includes the first input terminal receiving the first voltage and the second input terminal receiving the second voltage, and the operational amplifier outputs the common voltage to the output terminal.

12. The common voltage generator of claim 1, wherein the plurality of switches comprises:

a first switch pair connected to the first power supply terminal of the operational amplifier and configured to transmit one of the third voltage and the fifth voltage to the first power supply terminal;

a second switch pair connected to the second power supply terminal of the operational amplifier and configured to transmit one of the fourth voltage and the sixth voltage to the second power supply terminal; and a third switch pair connected to the first node and configured to transmit one of the fourth voltage and a seventh voltage to the first node.

13. The common voltage generator of claim 12, wherein, the first switch pair includes a first switch configured to transmit the third voltage to the first power supply terminal in response to a first switch control signal and a second switch configured to transmit the fifth voltage to the first power supply terminal in response to a second switch control signal, the second switch pair includes a third switch configured to transmit the fourth voltage to the second power supply terminal in response to a third switch control signal and a fourth switch configured to transmit the sixth voltage to the second power supply terminal in response to a fourth switch control signal, and the third switch pair includes a fifth switch configured to transmit the seventh voltage to the first node in response to a fifth switch control signal and a sixth switch configured to transmit the fourth voltage to the first node in response to a sixth switch control signal.

14. The common voltage generator of claim 13, wherein the first and third switch control signals have logic levels respectively complementary to logic levels of the second and fourth switch control signals, and the fifth switch control signal and the sixth switch control signal have complementary logic levels.

15. The common voltage generator of claim 12, further comprising:

at least one capacitor connected between the first power supply terminal and the second power supply terminal configured to decrease a switching noise of at least one of the first switch pair and the second switch pair.

16. The common voltage generator of claim 1, further comprising:

an input voltage generation unit configured to select and transmit one of a plurality of voltage levels in response to a first output control signal as the second voltage in the first voltage output mode and configured to select and transmit another of the plurality of voltage levels in response to a second output control signal as the second input voltage in the second voltage output mode.

17. The common voltage generator of claim 16, wherein input voltage generation unit determines the plurality of voltage levels correspond to a difference between a seventh voltage and the fourth voltage using at least one resistor.

18. A display device comprising:

a source driver;

a display panel; and the common voltage generator of claim 1.

19. A common voltage generator comprising:

an operational amplifier configured to amplify a difference between a first voltage received at a first input terminal and a second voltage received at a second input terminal and configured to output the amplified voltage as a common voltage to an output terminal;

a voltage divider connected between the output terminal and a first node, configured to divide a voltage between the output terminal and the first node and configured to output the divided voltage as the first voltage to the first input terminal; and an input voltage generation unit configured to select and transmit one of a plurality of voltage levels in response to a first output control signal as the second voltage in a first voltage output mode and configured to select and transmit another of the plurality of voltage levels in response to a second output control signal as the second voltage in a second voltage output mode.

20. The common voltage generator of claim 19, wherein the operational amplifier includes a first power supply terminal and a second power supply terminal, and the common voltage generator further comprises:

a plurality of switches configured to transmit a third voltage to the first power supply terminal and a fourth voltage to the second power supply terminal as a power supply to the operational amplifier in the first voltage output mode and configured to transmit a fifth voltage to the first power supply terminal and a sixth voltage to the second power supply terminal as the power supply to the operational amplifier in the second voltage output mode.

21. A method of generating a common voltage, the method comprising:

outputting a first common voltage using a first power voltage and a second power voltage as a power supply for an operational amplifier; and outputting a second common voltage using a third power voltage and a fourth power voltage as the power supply for the operational amplifier.

22. The method of claim 21, further comprising:

outputting a third common voltage using the third power voltage and the fourth power voltage as the power supply for the operational amplifier before the outputting of the first common voltage; and outputting a fourth common voltage using the first voltage and the second voltage as the power supply for the operational amplifier after the outputting of the first common voltage.

23. The method of claim 22, wherein a magnitude of the first, second, third and fourth common voltages satisfy a relationship of the first common voltage>the third common voltage>the fourth common voltage>the second common voltage.

* * * * *